US008998634B2

(12) United States Patent
Koellmann

(10) Patent No.: US 8,998,634 B2
(45) Date of Patent: Apr. 7, 2015

(54) CONDUCTOR TERMINAL

(75) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 12/250,026

(22) Filed: Oct. 13, 2008

(65) Prior Publication Data

US 2009/0104816 A1 Apr. 23, 2009

(30) Foreign Application Priority Data

Oct. 22, 2007 (DE) ..... 10 2007 050 683

(51) Int. Cl.
*H01R 11/20* (2006.01)
*H01R 9/26* (2006.01)
*H01R 4/48* (2006.01)

(52) U.S. Cl.
CPC ..... *H01R 9/26* (2013.01); *H01R 4/4836* (2013.01); *H01R 4/4845* (2013.01)

(58) Field of Classification Search
USPC ..... 439/436–441, 835–838
See application file for complete search history.

(56) References Cited

U.S. PATENT DOCUMENTS 6,336,824 B1 * 1/2002 Sorig ..... 439/441
2007/0099479 A1 5/2007 Holterhoff et al.

FOREIGN PATENT DOCUMENTS

DE 197 11 051 A1 3/1987
DE 101 03 187 A1 1/2001
JP 57-11838 A 7/1982

OTHER PUBLICATIONS (no english abstract or explanation or translation, rng Mar. 30, 2010). EP 303 818 A2 not scanned. DE patents have no english abstract or explanation. rng Mar. 30, 2010.

* cited by examiner

*Primary Examiner* — Ross Gushi
(74) *Attorney, Agent, or Firm* — Renner, Otto, Boisselle & Sklar, LLP

(57) ABSTRACT

A conductor terminal (1) having an insulating-material housing (6), at least one spring-force clamping contact (4) which is accommodated in the insulating-material housing (6), and having at least one operating pusher (8) which is operatively connected to at least one respective spring-force clamping contact (4) and is displaceably guided in a guide channel (1) in the insulating-material housing (6) in order to open and to close the associated spring-force clamping contact (4) is described. The at least one guide channel (10) has a recess (11) for accommodating a section of the operating pusher (8) which is guided in the respective guide channel (10). The recess (11) and the section of the operating pusher (8) are matched to one another in such a way that the operating pusher (8) can be fixed in an unlocking position, in which the spring-force clamping contact (4) is open, in the recess (11).

11 Claims, 3 Drawing Sheets

CONDUCTOR TERMINAL

FIELD OF THE INVENTION

The invention relates to a conductor terminal having an insulating-material housing, at least one spring-force clamping contact which is accommodated in the insulating-material housing, and having at least one operating pusher which is operatively connected to a respective spring-force clamping contact and is displaceably guided in a guide channel in the insulating-material housing in order to open and to close the associated spring-force clamping contact.

BACKGROUND

Conductor connections of this type are sufficiently well known, for example from DE 20 2005 014 510 U1. The operating pusher facilitates opening of the spring-force clamping contacts for inserting an electrical conductor.

DE 197 11 051 A1 describes an electrical terminal in which a pivot lever is incorporated in the insulating-material housing. Said pivot lever can be pivoted into the insulating-material housing with the aid of an operating tool, in order to move the clamping limb of a spring-force clamping connection and to open the spring-force clamping connection. The maximum pivoting movement of the pivot lever is limited by a stop in the insulating-material housing.

By way of example, DE 101 03 187 A1 discloses slide-operated electrical terminals. The slide-operated clamping limb of the clamping spring of the clamping point is positioned against a reference plane, which runs perpendicular to the linear track guides of the slide, with a V-shaped position, which is open at the top, and projects into the movement path of the slide. In the open position, a leading edge of the slide is extended under a retaining edge of the insulating-material housing, and so the return force of the clamping limb is also introduced into the retaining edge of the clamping housing and the operating slide is reliably fixed in position.

SUMMARY

Taking this as the starting point, the object of the present invention is to provide an improved conductor terminal with an insulating-material housing into which various operating pushers, which can be fixed at least in an unlocking position, can be integrated.

The object is achieved by the conductor terminal of the type mentioned in the introduction in that the at least one guide channel has a recess for accommodating a section of the operating pusher which is guided in the respective guide channel, and in that the recess and the section of the operating pusher are matched to one another in such a way that the operating pusher can be fixed in an unlocking position, in which the spring-force clamping contact is open, in the recess.

The invention therefore proposes guiding the operating pusher in a guide channel and not in a track guide, with a recess providing a clearance in the guide channel so that a section of the operating pusher can be moved in order to fix the operating pusher in the unlocking position. The manufacturer is responsible for fitting the guide channel having the recess with a suitable operating pusher. In this case, it is firstly feasible for an operating pusher which can be pivoted into the recess to be provided, in order to be able to exploit the advantage of fixing the operating pusher in an unlocking position. However, this functionality is undesirable or impermissible under certain circumstances, and so an operating pusher which has a different shape and does not have a section which can be fixed in the recess can also be inserted into the guide duct.

In order to permit the operating pusher to be moved into the recess, it is advantageous when the guide channel and/or the operating pusher have/has conically tapering wall sections in such a way that the operating pusher is mounted in the guide channel such that it can pivot into the recess in the guide channel. The section of the operating pusher which can be fixed in the recess should in this case be wider than the narrow end of the conically tapering wall section.

However, it is also advantageous when the operating pusher has a flexible section between the section which can be fixed in the recess and the section which interacts with the spring-force clamping contact, the flexible section permits the operating pusher to be pivoted into the recess in the guide channel.

However, it is also advantageous when the operating pusher has several parts and has at least two operating elements which are mounted such that they can be displaced relative to one another, main operating element is operatively connected to an associated spring-force clamping contact and a arresting operating element is provided with a section which interacts with the recess in the guide channel and in the main operating element, in order to fix the main operating pusher.

The additional arresting operating element has the advantage that arresting can be performed separately without transverse movement of the operating pusher and the position of the operating pusher, which is in the unlocked position, can be seen by way of the lug which may project far out of the insulating-material housing.

The unlocking position is understood to mean the unlocked position in which the spring-force clamping contact is open. Accordingly, the locking position is understood to be the position in which the spring-force clamping connection is closed.

In a multipartite operating pusher of this type, the arresting operating element preferably has a lug which extends in the longitudinal direction of the guide channel and projects from the insulating-material housing and has an arresting plate which branches obliquely from the lug. At least one indentation is provided in that wall of the main operating element which adjoins the lug, said indentation being matched to the recess in the guide channel and the arresting plate for fixing the main operating element in an unlocking position, in which the spring-force clamping contact is open, and/or in a locking position, in which the spring-force clamping contact is closed.

The spring-force clamping contact is closed by moving the lug which, in this case, delimits the main operating element which bounces up in the guide channel.

In order to fix the main operating element which can have the form of a cylindrical or cuboidal ram, it is advantageous that the at least one indentation in the main operating element enters the material of the main operating element obliquely in the direction of the spring-force clamping contact. In this way, the indentation of triangular cross section provides a bearing face for the arresting plate which is supported on the opposite side in the recess in the guide channel and, on account of the oblique profile of the arresting plate, prevents displacement of the main operating element in the guide channel in the upward direction away from the spring-force clamping connection.

The externally visible head area of the operating pusher can be used to receive an operating tool and/or to identify the ability to lock the operating pusher and/or to identify a predefined type of line connection. It is therefore advantageous when a cavity for accommodating an operating tool is provided in the externally accessible head section of the operating pusher, that the cavity may be of slot-like or cross-like design. The shape of the cavity can then also be used as an identifier of a predefined type of line connection of the associated conductor connection. For example, a slot-like cavity may indicate a negative pole and a cross-like cavity may indicate a positive pole. However, it is also feasible for the phase or the like of the voltage potential which is provided for the conductor connection to be identified with the aid of the cavity.

It is also advantageous to have a warning cover cap for closing the guide channel and preventing unintentional operation connected in a pivotable and articulated manner to the outer wall of the insulating-material housing so as to adjoin the guide channel.

DESCRIPTION OF THE DRAWINGS

The invention is explained in greater detail below with reference to exemplary embodiments and the appended drawings, in which.

DETAILED DESCRIPTION

Figure 1:
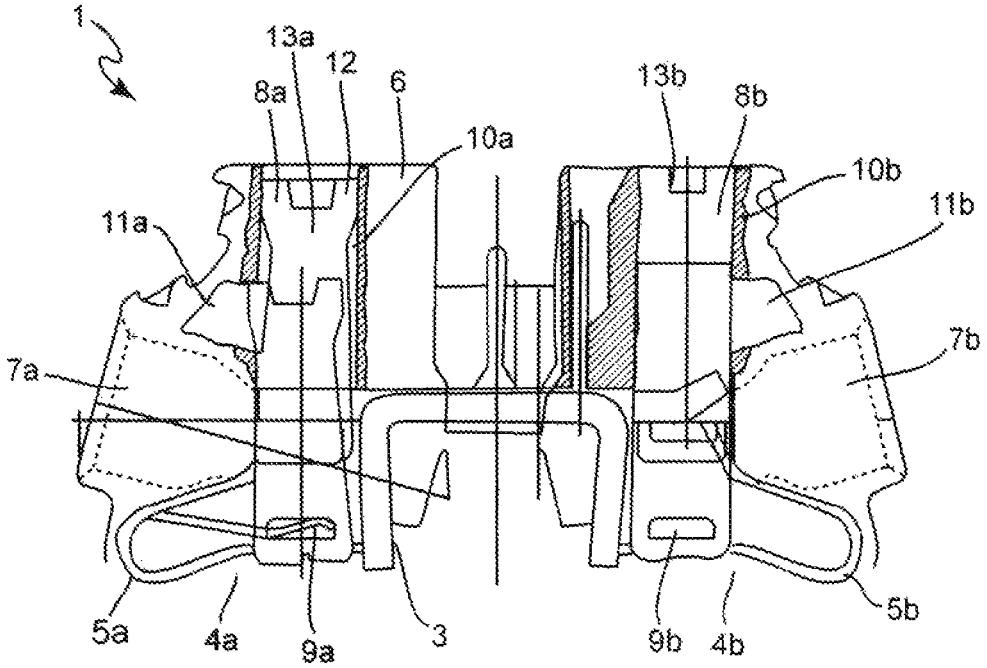
FIG. 1—shows a partial cut away, cross-sectional view of a conductor terminal with two spring-force clamping connections which are connected to one another by means of a busbar.

FIG. 1 shows a first embodiment of the conductor terminal 1 in cross section. The conductor terminal 1 has two spring-force clamping contacts 4*a*, 4*b* which are electrically conductively connected to one another by means of a busbar 3 and which are formed substantially from the busbar 3 and a clamping spring 5*a*, 5*b*. The spring-force clamping contacts 5*a*, 5*b* and the busbar 3 are accommodated in an insulating-material housing 6 in which the conductor insertion openings 7*a*, 7*b* which are oriented toward the spring-force clamping contacts 4*a*, 4*b* are made.

In order to open the clamping springs 5*a*, 5*b*, operating pushers 8*a*, 8*b* which are operatively connected to the clamping springs 5*a*, 5*b* are provided. To this end, at the guide slot 9*a*, 9*b* in which a guide section of the clamping spring 5*a*, 5*b* is hooked is in each case provided in the lower end region of the operating pushers 8*a*, 8*b*.

The operating pushers 8*a*, 8*b* are displaceably inserted into a respective guide channel 10*a*, 10*b* of the insulating-material housing 6. The guide channels 10*a*, 10*b* in each case contain a recess 11*a*, 11*b* into which the operating pusher 8*a* can be pivoted when the guide channel 10*a* and the shape of the operating pusher 8*a* are suitably configured, in order to fix the operating pusher in an unlocking position in which the spring-force clamping contact is open. This is shown by the down position of pusher 8*a*in the lower position in FIG. 1. This has the advantage that a conductor can be easily inserted into and removed from the conductor guide opening 7*a* without continuously pressing down on the operating pusher 8*a*.

Although the guide channel 10*a*, 10*b*, by virtue of the respective recess 11*a*, 11*b*, permits an operating pusher 8*a* to be fixed in principle, another operating pusher 8*b* can optionally be used without reconfiguring the insulating-material housing 6, said other operating pusher preventing tilting into the recess 11*b* on account of its, for example, rectangular shape together with a constant cross section over the length, and it therefore not being possible to fix it.

In contrast to the rectangular operating pusher 8*b*, the left-hand, pivotable operating pusher 8*a* is configured in such a way that it has a cross section which tapers conically in the direction of the head section from that end which is operatively connected to the spring-force clamping contact 4*a*, and so the cross section reduces in the direction of the head end. In contrast, the head section 12 is again wider, and so the upper edge of the head section 12 for fixing the operating pusher 8*a* butts against an upper edge of the recess 11*a* when the operating pusher 8*a* is pivoted into the recess 11*a*.

The pivoting movement is made possible by the conically tapering wall adjoining the wall of the guide channel 10*a* in which the recess 11*a* is made.

However, it is also feasible for the wall of the guide channel 10*a* to be recessed beneath the recess 11*a* itself in order to permit the operating pusher 8*a* to be pivoted into the recess 11*a*. However, this has the disadvantage of poorer guidance of the operating pusher which cannot be fixed. In order to facilitate operation of the operating pusher 8*a*, 8*b* using an operating tool and possibly pivoting of the operating pusher 8*a*, a cavity 13*a*, 13*b* is made in the head section 12.

Figure 2:
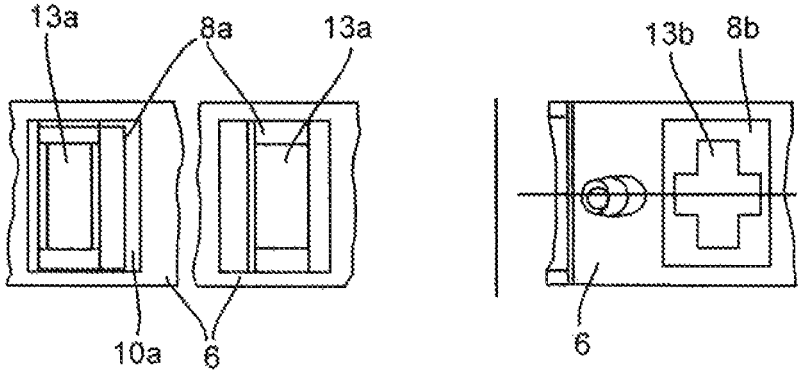
FIG. 2—shows a detail of a plan view of the conductor terminal from FIG. 1.

FIG. 2, which shows a plan view of the conductor terminal 1 from FIG. 1, shows that the cavity 13*a* of the operating pusher 8*a* on the left-hand side is in the form of a slot, whereas the cavity 13*b* of the operating pusher 8*b* on the right-hand side is in the form of a cross. The type of operating pusher can therefore be identified. For example, the slot-like cavity may indicate that the operating pusher 8*b* cannot be fixed. However, it is also feasible to identify the cavity 13*a*, 13*b* and to use the type of conductor connection provided. Therefore, a slot-like cavity can also indicate, for example, the negative polarity or an earth potential of the voltage potential provided for the conductor connection, whereas the slot indicates a positive voltage potential or a voltage-conducting phase. Virtually any further designs of the cavity 3*a*, 3*b* are feasible.

In the left-hand illustration of the head section 12 of the operating pusher 8*a*, it is clear that the operating pusher 8*a* is pivoted to the left into the recess covered by the insulating-material housing 6 (compared to the adjoining right-hand illustration of the plan view of the operating pusher 8*a*).

Figure 3:
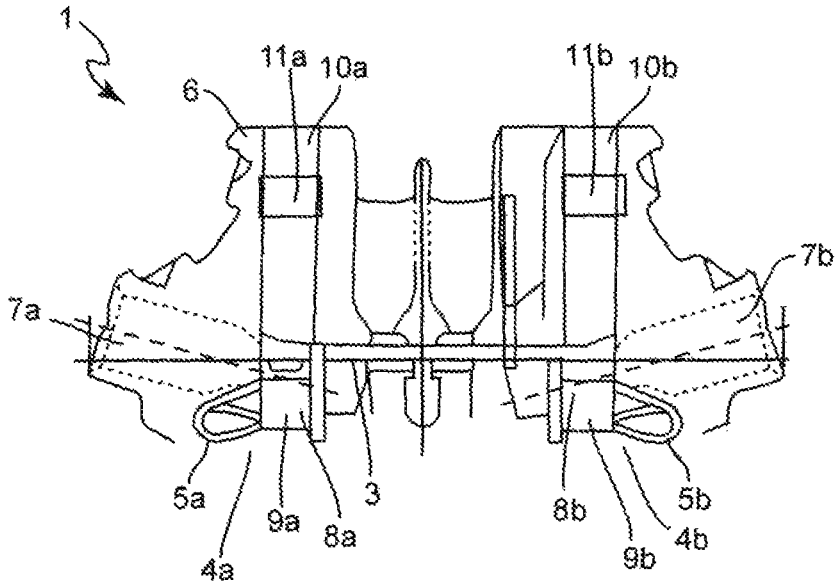
FIG. 3—shows a partial cut away, cross-sectional view of a second embodiment of a conductor terminal.

FIG. 3 shows a cross-sectional view of a second embodiment of the conductor terminal 1, in which a recess 11*a*, 11*b* is made in the side wall of the guide channels 10*a*, 10*b*.

Figure 4:
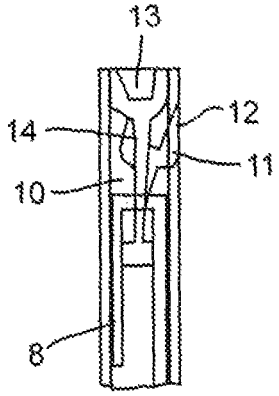
FIG. 4—shows a sectional view of the guide channel of the conductor terminal from FIG. 3 with flexible operating pushers.

As can be seen in the sectional view from FIG. 4 through the guide channel 10, the operating pusher 8 can be pivoted laterally into the recess 11 with the aid of a flexible section 14. The head section 12 then butts against the upper edge of the recess 11 and is wedged in there in order to prevent the operating pusher 8 from bouncing up and thereby closing the spring-force clamping contact 4 (not illustrated in FIG. 4) which is operatively connected to the operating pusher 8.

Figure 5:
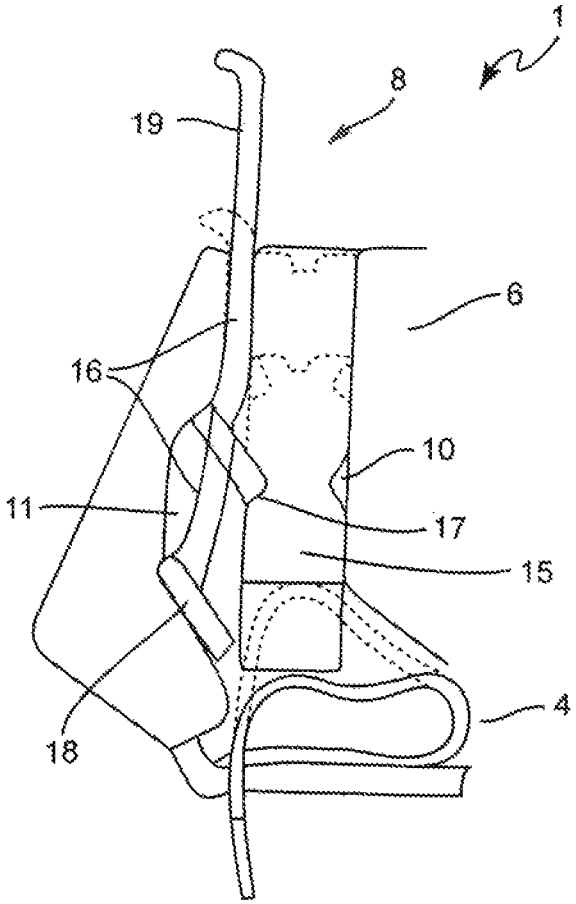
FIG. 5—shows a detailed sectional view of a third embodiment of a conductor terminal with a two-part operating pusher.

FIG. 5 shows a detailed sectional view of a third embodiment of the conductor terminal 1. It is clear that the operating pusher 8 is of two-part design and has a main operating element 15 and an arresting operating element 16 which is illustrated in the open and in the closed position.

The main operating element 15 has, at least on the wall which adjoins the arresting operating element 16, indentations 17 in the form of incisions which run obliquely into the material of the main operating element 15 in the direction of the spring-force clamping contact 4. A recess 11 is again made in the guide channel 10 for the main operating element 15, and so a clearance is created between the indentation 17 and the recess 11. This clearance is used by an arresting plate 18 of the arresting operating element 16, which arresting plate branches obliquely from a lug 19 of the arresting operating element 16. When the main operating element 15 is pressed down in order to open the associated spring-force clamping contact 4, the indentation 17 is located obliquely beneath the upper edge of the recess 11, and so the arresting plate 18 can be clamped between the upper edge of the recess 11 and the lower edge of the indentation 17 when the lug 19 is drawn in the upward direction out of the insulating-material housing 6. It is therefore possible to arrest the operating pusher 8 without the aid of the tool. In addition, the open state of the spring-force clamping contact 4 can be made clearly visible from the outside.

The invention claimed is:

1. A conductor terminal, comprising:

an insulating-material housing;

a spring-force clamping contact which is accommodated in the insulating-material housing and which is movable between open and closed positions;

an operating pusher which is operatively connected to said spring-force clamping contact and is longitudinally guided in a guide channel in the insulating-material housing along a movement axis between first and second positions in order to move the at least one spring-force clamping contact from the closed position to the open position, wherein the guide channel has in a side thereof a recess for accommodating a section of the operating pusher when the operating pusher is in the second position, and when the operating pusher is in the second position, the section of the operating pusher is laterally movable toward and away from the movement axis between a first position outside the recess and a second position in the recess where it can engage an opposing side of the recess for blocking movement of the operating pusher from the second position to the first position so that the operating pusher will hold the spring-force clamping contact in the open position.

2. The conductor terminal according to claim 1, wherein the operating pusher includes at least two operating elements which are mounted such that they can be displaced relative to one another, of which a main operating element is operatively connected to said spring-force clamping contact and an arresting operating element is provided on a section which interacts with the recess in the guide channel and the main operating element, in order to fix the main operating element.

3. The conductor terminal according to claim 2, wherein the arresting operating element has a lug which extends in the longitudinal direction of the guide channel and projects from the insulating-material housing at one end and has an arresting plate which branches obliquely at the other end, and wherein an indentation is provided in a wall of the main operating element adjacent the arresting operating element, said at least one indentation being matched to the recess in the guide channel and the arresting plate for fixing the main operating element in an unlocking position, in which the spring-force clamping contact is open, and/or in a locking position, in which the spring-force clamping contact is closed.

4. The conductor terminal according to claim 3, wherein the indentation in the main operating element enters the main operating element obliquely in the direction of the spring-force clamping contact.

5. The conductor terminal according to claim 1 wherein the guide channel and/or the operating pusher has a conically tapering wall section in such a way that the operating pusher is mounted in the guide channel such that it can pivot into the recess.

6. The conductor terminal according to claim 1, wherein the operating pusher has a flexible section which permits the operating pusher to be pivoted into the recess.

7. The conductor terminal according to claim 1 further comprising a cavity in an externally accessible head section of the operating pusher which can receive an operating tool.

8. The conductor terminal according to claim 7, wherein the shape of the cavity represents an identifier of a predefined type of conductor connection.

9. The conductor terminal according to claim 8 wherein the type of conductor connection is the polarity or phase of the voltage potential provided for the conductor connection.

10. The conductor terminal according to claim 1, wherein when the spring-force clamping contact is in the closed position a clamping portion of the spring-force clamping contact is positionally closer to the recess than when the spring-force clamping contact is in the open position.

11. The conductor terminal according to claim 1 wherein the insulating-material housing accommodates additional spring-force clamping contacts and corresponding operating pushers and guide channels.

* * * * *